US009492759B2

(12) United States Patent
Sheltman

(10) Patent No.: US 9,492,759 B2
(45) Date of Patent: Nov. 15, 2016

(54) WHEELED TOY VEHICLES AND PLAYSETS FOR USE THEREWITH

(75) Inventor: David Sheltman, Rancho Palos Verdes, CA (US)

(73) Assignee: Mattel, Inc., El Segundo, CA (US)

( * ) Notice: Subject to any disclaimer, the term of this patent is extended or adjusted under 35 U.S.C. 154(b) by 1132 days.

(21) Appl. No.: 11/744,718

(22) Filed: May 4, 2007

(65) Prior Publication Data

US 2008/0032596 A1 Feb. 7, 2008

Related U.S. Application Data

(60) Provisional application No. 60/798,006, filed on May 4, 2006, provisional application No. 60/812,311, filed on Jun. 9, 2006.

(51) Int. Cl.

| | |
|---|---|
| ***A63H 18/00*** | (2006.01) |
| ***A63H 11/10*** | (2006.01) |
| ***A63H 18/02*** | (2006.01) |
| ***A63H 18/06*** | (2006.01) |

(52) U.S. Cl.

CPC ..... *A63H 11/10* (2013.01); *A63H 18/028* (2013.01); *A63H 18/06* (2013.01)

(58) Field of Classification Search

CPC .... A63H 17/008; A63H 18/028; A63G 7/00; A63G 21/04

See application file for complete search history.

(56) References Cited

U.S. PATENT DOCUMENTS

| | | | |
|---|---|---|---|
| 293,853 | A | 2/1884 | Dolbeer |
| 336,535 | A | 2/1886 | Voigt |
| 455,079 | A | 6/1891 | Warner |
| 647,327 | A | 4/1900 | Rehlin |
| 719,200 | A | 1/1903 | Dean |
| 758,047 | A | 4/1904 | Chein |
| 810,313 | A | 1/1906 | Ravel |
| 817,928 | A | 4/1906 | Medley |
| 826,560 | A | 7/1906 | Garanger |

(Continued)

FOREIGN PATENT DOCUMENTS

| | | |
|---|---|---|
| DE | 3240712 | 5/1984 |
| DE | 29922213 | 3/2000 |

(Continued)

OTHER PUBLICATIONS

US Patent and Trademark Office, Office Action, Jul. 22, 2010, 9 pages.

(Continued)

*Primary Examiner* — Melba Bumgarner
*Assistant Examiner* — Urszula M Cegielnik
(74) *Attorney, Agent, or Firm* — Kolisch Hartwell, P.C.

(57) ABSTRACT

A play system includes a toy vehicle and a playset for use therewith. A toy vehicle includes a chassis having a top surface and a bottom surface, the bottom surface including structure configured to define a pair of substantially parallel grooves across the bottom surface of the chassis, and a plurality of wheels rotatably mounted to the chassis and configured to roll the chassis on a surface in a predetermined rolling direction. A playset includes a first track section adapted to engage the grooves on the bottom surface of the toy vehicle for slidable movement thereon, a second track section adapted to engage the plurality of wheels of the toy vehicle for rolling movement thereon, and a connecting portion to couple the track portions.

22 Claims, 8 Drawing Sheets

(56) References Cited

U.S. PATENT DOCUMENTS

| | | | | | |
|---|---|---|---|---|---|
| 836,561 | A | | 11/1906 | Bush | |
| 855,949 | A | | 6/1907 | Hoffman | |
| 1,256,575 | A | | 2/1918 | Koprinski | |
| 1,279,712 | A | | 9/1918 | Knudsen | |
| 1,424,659 | A | | 8/1922 | Linder | |
| 1,542,063 | A | | 10/1924 | Knight | |
| 1,536,436 | A | | 5/1925 | Kolinski | |
| 1,542,012 | A | | 6/1925 | Spilman | |
| 1,544,555 | A | | 7/1925 | Chase | |
| 1,569,225 | A | | 1/1926 | Gunderman | |
| 1,576,515 | A | | 4/1926 | Kinney | |
| 1,589,286 | A | | 6/1926 | Zabel | |
| 1,661,865 | A | | 3/1928 | Zabel | |
| 1,695,310 | A | | 12/1928 | Wustendorfer | |
| 1,817,959 | A | | 4/1930 | Bloxom | |
| 1,859,764 | A | | 5/1932 | Bougon | |
| 2,159,966 | A | | 3/1937 | Dunham | |
| 2,153,957 | A | | 2/1938 | Davis | |
| 2,115,108 | A | * | 4/1938 | Horn | 104/305 |
| 2,239,395 | A | | 4/1941 | Mallory | |
| 2,279,857 | A | | 4/1942 | Bodnar | |
| 2,327,702 | A | | 8/1943 | Flynt | |
| 2,416,473 | A | | 2/1947 | Fields | |
| 2,498,974 | A | | 3/1949 | Wilbik | |
| 2,559,865 | A | | 7/1951 | Fleishman | |
| 2,718,727 | A | | 3/1952 | Laissue | |
| 2,817,925 | A | | 12/1954 | Kelley | |
| 2,799,502 | A | | 7/1957 | Isakson | |
| 2,803,922 | A | | 8/1957 | Holt | |
| 2,824,409 | A | | 2/1958 | Brodrib | |
| 2,999,689 | A | | 9/1961 | Litwinczuk | |
| 3,005,285 | A | * | 10/1961 | Girz | 446/469 |
| 3,018,584 | A | | 1/1962 | Passariello | |
| 3,108,810 | A | | 10/1963 | Wiley, Jr. | |
| 3,126,670 | A | | 3/1964 | Smith | |
| 3,132,441 | A | | 5/1964 | Mahovsky | |
| 3,209,491 | A | * | 10/1965 | Roeper | 446/444 |
| 3,233,363 | A | | 2/1966 | Maury | |
| 3,299,565 | A | | 1/1967 | Yarashes | |
| 3,308,575 | A | * | 3/1967 | Lemelson | 446/138 |
| 3,425,694 | A | | 2/1969 | Norris | |
| 3,457,671 | A | | 7/1969 | Roth | |
| 3,528,385 | A | | 9/1970 | Kohner et al. | |
| 3,542,366 | A | | 11/1970 | Schocker | |
| 3,587,190 | A | | 6/1971 | Ashton | |
| 3,626,635 | A | * | 12/1971 | Birdsall | 446/136 |
| 3,653,662 | A | | 4/1972 | Welbourn | |
| 3,665,636 | A | | 5/1972 | Benson et al. | |
| 3,675,924 | A | | 7/1972 | Smith | |
| 3,683,514 | A | | 8/1972 | Hughes | |
| 3,690,393 | A | | 9/1972 | Guy | |
| 3,698,130 | A | * | 10/1972 | Usami | 446/445 |
| D225,247 | S | | 11/1972 | Hughes | |
| 3,711,096 | A | | 1/1973 | Cramp et al. | |
| 3,711,989 | A | * | 1/1973 | Nielsen et al. | 446/469 |
| 3,715,121 | A | | 2/1973 | Renn et al. | |
| 3,721,036 | A | | 3/1973 | Goldfarb | |
| 3,797,164 | A | | 3/1974 | Glass et al. | |
| 3,814,021 | A | | 6/1974 | McHenry | |
| 3,817,528 | A | | 6/1974 | Stuhler | |
| 3,858,875 | A | | 1/1975 | Nemeth et al. | |
| 3,870,308 | A | | 3/1975 | Reilly | |
| 3,926,435 | A | | 12/1975 | Nacci | |
| 3,952,442 | A | | 4/1976 | Livesey et al. | |
| 4,016,674 | A | | 4/1977 | Resnick et al. | |
| 4,031,660 | A | * | 6/1977 | Chen | 446/132 |
| 4,055,343 | A | | 10/1977 | Stuart | |
| 4,068,402 | A | | 1/1978 | Tanaka | |
| 4,085,933 | A | | 4/1978 | Currie | |
| 4,087,935 | A | | 5/1978 | Edmisson et al. | |
| 4,094,089 | A | | 6/1978 | Sano | |
| 4,129,916 | A | | 12/1978 | Schlesinger et al. | |
| 4,171,090 | A | | 10/1979 | Eisenburg | |
| 4,185,409 | A | | 1/1980 | Cheng | |
| 4,221,076 | A | | 9/1980 | Ozawa | |
| 4,227,693 | A | | 10/1980 | Moe et al. | |
| 4,254,576 | A | | 3/1981 | Matsumoto et al. | |
| 4,261,568 | A | | 4/1981 | Such | |
| 4,267,661 | A | | 5/1981 | Hanson | |
| 4,299,387 | A | | 11/1981 | Nishimiya | |
| 4,303,247 | A | | 12/1981 | Fain | |
| 4,305,587 | A | | 12/1981 | O | |
| 4,321,906 | A | | 3/1982 | Thornell | |
| 4,345,402 | A | | 8/1982 | Hanson et al. | |
| 4,386,777 | A | * | 6/1983 | Prehodka | 104/281 |
| 4,394,961 | A | | 7/1983 | Muller | |
| 4,402,507 | A | | 9/1983 | Hudson | |
| 4,403,440 | A | | 9/1983 | Wulff | |
| 4,408,413 | A | * | 10/1983 | Hyland et al. | 446/138 |
| 4,423,871 | A | | 1/1984 | Mucaro | |
| 4,468,031 | A | | 8/1984 | Barlow et al. | |
| 4,488,723 | A | | 12/1984 | LaGrow | |
| 4,513,967 | A | | 4/1985 | Halford et al. | |
| 4,519,789 | A | | 5/1985 | Halford et al. | |
| 4,536,168 | A | * | 8/1985 | Stephens | 446/444 |
| 4,537,577 | A | * | 8/1985 | Sansome et al. | 446/445 |
| 4,571,204 | A | | 2/1986 | Wang | |
| 4,575,346 | A | | 3/1986 | Ogawa | |
| RE32,106 | E | | 4/1986 | Lemelson | |
| 4,585,166 | A | | 4/1986 | Stephens | |
| 4,661,080 | A | | 4/1987 | Goldstein et al. | |
| 4,690,658 | A | | 9/1987 | Crosson et al. | |
| 4,694,209 | A | * | 9/1987 | Shindou | 446/469 |
| 4,697,812 | A | | 10/1987 | Rudell et al. | |
| 4,708,685 | A | | 11/1987 | Udagawa | |
| 4,715,843 | A | | 12/1987 | Ostendorff et al. | |
| 4,767,053 | A | | 8/1988 | Cook et al. | |
| 4,836,819 | A | | 6/1989 | Oishi et al. | |
| 4,850,929 | A | * | 7/1989 | Genevey | 446/469 |
| 4,874,342 | A | | 10/1989 | Klitsner | |
| 4,889,513 | A | | 12/1989 | Paddock | |
| 4,928,955 | A | | 5/1990 | Chuan | |
| 4,940,444 | A | * | 7/1990 | Russell | 446/444 |
| 4,979,926 | A | | 12/1990 | Bisceglia | |
| 5,007,876 | A | | 4/1991 | Klitsner | |
| 5,038,685 | A | * | 8/1991 | Yoneda et al. | 104/54 |
| 5,052,972 | A | | 10/1991 | Suimon et al. | |
| 5,069,460 | A | | 12/1991 | Kulesza | |
| 5,102,133 | A | | 4/1992 | Chilton et al. | |
| 5,112,052 | A | | 5/1992 | Yamaura | |
| 5,122,089 | A | | 6/1992 | Haran | |
| 5,141,467 | A | | 8/1992 | Crosbie | |
| 5,173,071 | A | | 12/1992 | Hoeting | |
| 5,174,569 | A | * | 12/1992 | Ngai | 104/67 |
| 5,234,216 | A | | 8/1993 | Ostendorff | |
| 5,242,164 | A | | 9/1993 | Nicoll | |
| 5,334,079 | A | | 8/1994 | Gentile et al. | |
| 5,433,641 | A | | 7/1995 | Rudell et al. | |
| 5,435,570 | A | | 7/1995 | Labrasseur | |
| 5,452,893 | A | | 9/1995 | Faulk et al. | |
| 5,542,668 | A | | 8/1996 | Casale et al. | |
| 5,560,625 | A | * | 10/1996 | Kuykendall | 280/11.221 |
| 5,601,490 | A | | 2/1997 | Nakagawa et al. | |
| 5,613,683 | A | | 3/1997 | Ying et al. | |
| 5,678,489 | A | | 10/1997 | Wang | |
| 5,690,330 | A | | 11/1997 | Ozawa | |
| 5,709,385 | A | | 1/1998 | Fitzpatrick et al. | |
| 5,752,703 | A | | 5/1998 | Wong | |
| 5,800,240 | A | | 9/1998 | Jackson | |
| 5,855,501 | A | | 1/1999 | Kato et al. | |
| 5,865,661 | A | | 2/1999 | Cyrus et al. | |
| 5,890,945 | A | | 4/1999 | Asami et al. | |
| 5,931,714 | A | | 8/1999 | Johnson | |
| 6,042,480 | A | | 3/2000 | Labelson | |
| 6,056,619 | A | | 5/2000 | Wiggs et al. | |
| 6,074,271 | A | | 6/2000 | Derrah | |
| 6,093,079 | A | | 7/2000 | House | |
| 6,105,965 | A | | 8/2000 | Perry | |
| 6,105,978 | A | * | 8/2000 | Vuerchoz | 280/11.27 |
| 6,193,581 | B1 | | 2/2001 | Wiggs et al. | |
| 6,200,193 | B1 | | 3/2001 | Nadel | |
| 6,315,630 | B1 | | 11/2001 | Yamasaki | |
| 6,322,415 | B1 | | 11/2001 | Cyrus et al. | |
| 6,350,174 | B1 | | 2/2002 | Halford et al. | |

(56) References Cited

U.S. PATENT DOCUMENTS

| | | | | |
|---|---|---|---|---|
| 6,460,868 | B2 * | 10/2002 | Madrid | 280/87.042 |
| 6,475,052 | B1 | 11/2002 | Liu | |
| 6,478,654 | B1 | 11/2002 | Rehkemper et al. | |
| 6,482,070 | B2 * | 11/2002 | Hogan | 446/462 |
| 6,488,559 | B1 | 12/2002 | Hintz | |
| 6,508,179 | B2 | 1/2003 | Annis et al. | |
| 6,527,284 | B2 * | 3/2003 | Bert | 280/87.042 |
| 6,533,638 | B1 | 3/2003 | Nelson et al. | |
| 6,540,577 | B1 | 4/2003 | Nelson et al. | |
| 6,547,625 | B2 | 4/2003 | Whitehead | |
| 6,623,367 | B1 | 9/2003 | Labelson et al. | |
| 6,638,168 | B1 | 10/2003 | Rehkemper | |
| 6,672,968 | B2 | 1/2004 | Montolio | |
| 6,676,476 | B1 | 1/2004 | Lund et al. | |
| 6,676,480 | B2 | 1/2004 | Sheltman | |
| 6,695,707 | B1 | 2/2004 | Fernandez et al. | |
| D487,486 | S | 3/2004 | Bao | |
| 6,726,523 | B2 | 4/2004 | Baker et al. | |
| D489,786 | S | 5/2004 | Pratt | |
| 6,746,298 | B1 * | 6/2004 | Doepner et al. | 446/126 |
| 6,776,685 | B2 | 8/2004 | Reisher et al. | |
| 6,782,577 | B2 | 8/2004 | Rieber et al. | |
| 6,875,116 | B2 * | 4/2005 | Tessier | 472/89 |
| 6,887,121 | B2 | 5/2005 | Whitehead | |
| 6,953,377 | B2 | 10/2005 | Quercetti | |
| 6,971,942 | B2 * | 12/2005 | Baker et al. | 446/275 |
| D517,829 | S | 3/2006 | McCoy et al. | |
| 7,160,171 | B1 | 1/2007 | Rehkemper et al. | |
| 7,195,562 | B2 * | 3/2007 | Soderberg | 472/89 |
| 7,201,386 | B2 * | 4/2007 | Walker, IV | B62B 15/008 280/87.021 |
| 2002/0182975 | A1 | 12/2002 | Schaffer | |
| 2003/0125120 | A1 | 7/2003 | Montolio | |
| 2003/0176226 | A1 | 9/2003 | Kelsey | |
| 2003/0216102 | A1 | 11/2003 | Reisher et al. | |
| 2003/0224697 | A1 | 12/2003 | Sheltman | |
| 2004/0104551 | A1 * | 6/2004 | Jacobs | 280/87.042 |
| 2005/0075037 | A1 | 4/2005 | Whitehead | |
| 2005/0075177 | A1 | 4/2005 | Bork et al. | |
| 2005/0112988 | A1 | 5/2005 | Whitehead | |
| 2005/0124425 | A1 | 6/2005 | Talafous | |
| 2005/0191938 | A1 | 9/2005 | Sheltman et al. | |
| 2005/0287918 | A1 | 12/2005 | Sheltman et al. | |
| 2006/0141902 | A1 | 6/2006 | Sinisi | |
| 2006/0214756 | A1 | 9/2006 | Elliott et al. | |
| 2007/0015594 | A1 | 1/2007 | Laurienzo et al. | |
| 2007/0049160 | A1 * | 3/2007 | Matthes et al. | 446/444 |
| 2007/0057080 | A1 * | 3/2007 | Ngai | 238/10 F |
| 2007/0197126 | A1 | 8/2007 | Derrah | |

FOREIGN PATENT DOCUMENTS

| | | |
|---|---|---|
| EP | 1230963 A2 | 8/2002 |
| EP | 1230963 B1 | 7/2004 |
| EP | 1530991 | 5/2005 |
| FR | 2555459 | 5/1985 |
| FR | 2640886 | 6/1990 |
| GB | 2130903 | 6/1984 |
| GB | 2155978 | 10/1985 |
| GB | 2184662 | 7/1987 |
| GB | 2186501 | 8/1987 |
| GB | 2200297 | 8/1988 |
| JP | 2000-279652 | 10/2000 |
| WO | 92/01497 | 2/1992 |

OTHER PUBLICATIONS

United States Patent and Trademark Office; Office Action for U.S. Appl. No. 12/114,992; Jul. 27, 2012; 34 pages.

U.S. Patent and Trademark Office, Office Action for U.S. Appl. No. 13/114,992, Feb. 13, 2013, 12 pages.

* cited by examiner

WHEELED TOY VEHICLES AND PLAYSETS FOR USE THEREWITH

RELATED APPLICATIONS

This application claims priority under 35 U.S.C. §119(e) to U.S. Provisional Application Ser. No. 60/798,006 filed on May 4, 2006, and Ser. No. 60/812,311 filed on Jun. 9, 2006, the disclosures of which are incorporated herein by reference for all purposes.

TECHNICAL FIELD

The present disclosure relates generally to toy vehicles and playsets, and more particularly to wheeled toy vehicles which include groove-defining structure on a bottom surface of the vehicle chassis, such that the vehicles may roll across a surface or slide along a pair of raised rails, bars, or similar structure, and to playsets that incorporate track sections configured to engage either the wheels of a toy vehicle, the groove-defining structure of a toy vehicle, or both. The disclosure is also directed to wheeled toy vehicles as described that also include a magnetic portion on the bottom surface, and playsets for use therewith, which include one or more magnetic components configured to attract or repel the magnetic portion of a toy vehicle.

BACKGROUND OF THE DISCLOSURE

Examples of wheeled toy vehicles can be found in U.S. Pat. Nos. 6,725,523, 6,676,476, 6,315,630, 6,074,271, 4,836,819, D487,486, and U.S. Patent Application Publication No. US20050112988. Examples of play sets incorporating magnets can be found in U.S. Pat. Nos. 6,322,415, 6,193,581, 6,056,619, 5,931,714, 3,653,662, and 6,473,27. Examples of play sets incorporating rolling surfaces or sliding surfaces can be found in U.S. Pat. Nos. 5,800,240, 5,542,668, 4,171,090, 4,094,089, 3,721,036, 3,683,514, 3,108,810, 2,999,689, 1,695,310, 758,047, and 719,200. The disclosures of all of the patents, patent applications, and publications recited are incorporated herein by reference.

DETAILED DESCRIPTION AND BEST MODE OF THE DISCLOSURE

Figure 1:
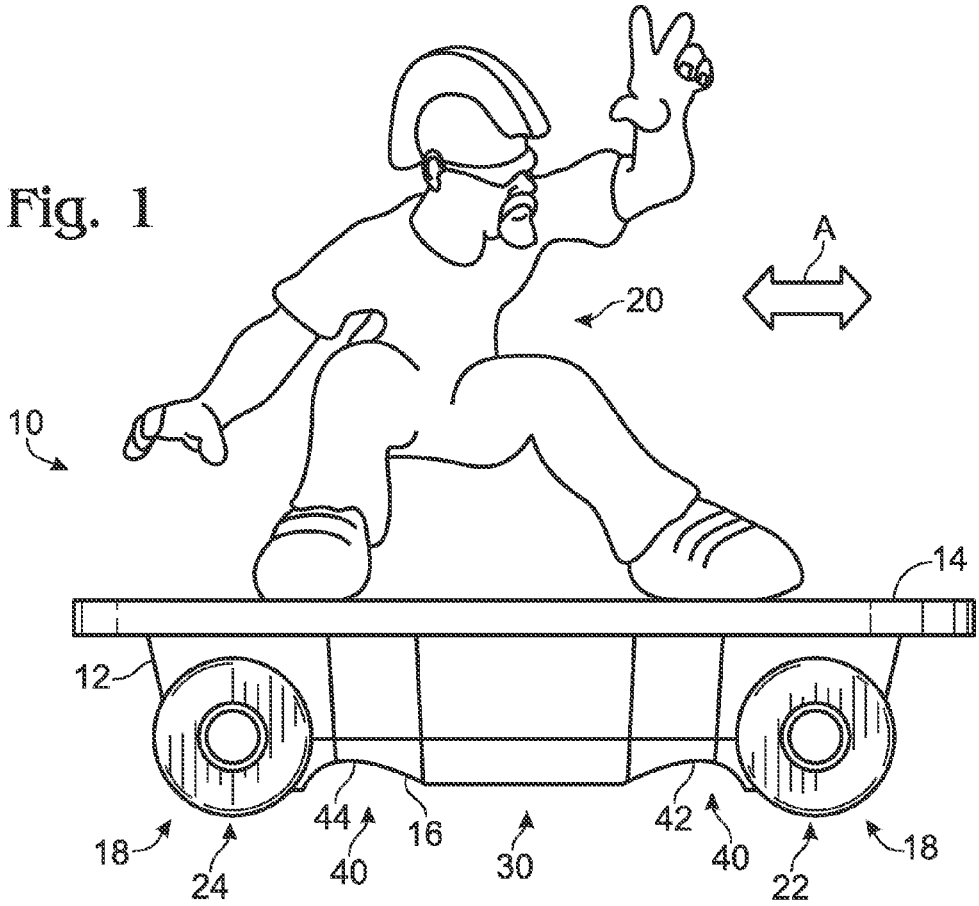
FIG. 1 is a side view of a wheeled toy vehicle according to the present disclosure.

FIGS. 1-15 show examples of various components of a toy system which may include wheeled toy vehicles and a variety of toy playsets for use with such vehicles. An illustrative embodiment of a wheeled toy vehicle of the present disclosure is shown in FIG. 1 as wheeled toy vehicle 10. Wheeled toy vehicle 10 includes a chassis 12 having a top surface 14, a bottom surface 16, and a plurality of wheels 18 rotatably mounted to the chassis. Top surface 16 is further shown to include a posed toy FIG. 20, shaped to resemble a skateboarder. In the illustrated example, the chassis and wheels are configured to resemble a skateboard, and thus toy vehicle 10 resembles a skateboarder riding a skateboard. As shown in the figures and as discussed herein, the wheeled toy figures and toy playsets of the toy system are generally configured to further the theme of skateboarders performing various tricks and stunts. However, the theme presented in the specific embodiments illustrated and discussed herein is illustrative in nature and should not be considered in a limiting sense, as many variants are possible.

For example, in embodiments consistent with a skateboarder theme, wheeled toy vehicles may include differently configured toy figures, such as skateboarder figures in different poses and/or having different physical characteristics. For example, skateboarder figures may include features simulating clothing and/or equipment such as helmets, elbow pads, knee pages, loose pants, jackets, or any other desired feature.

Figure 2:
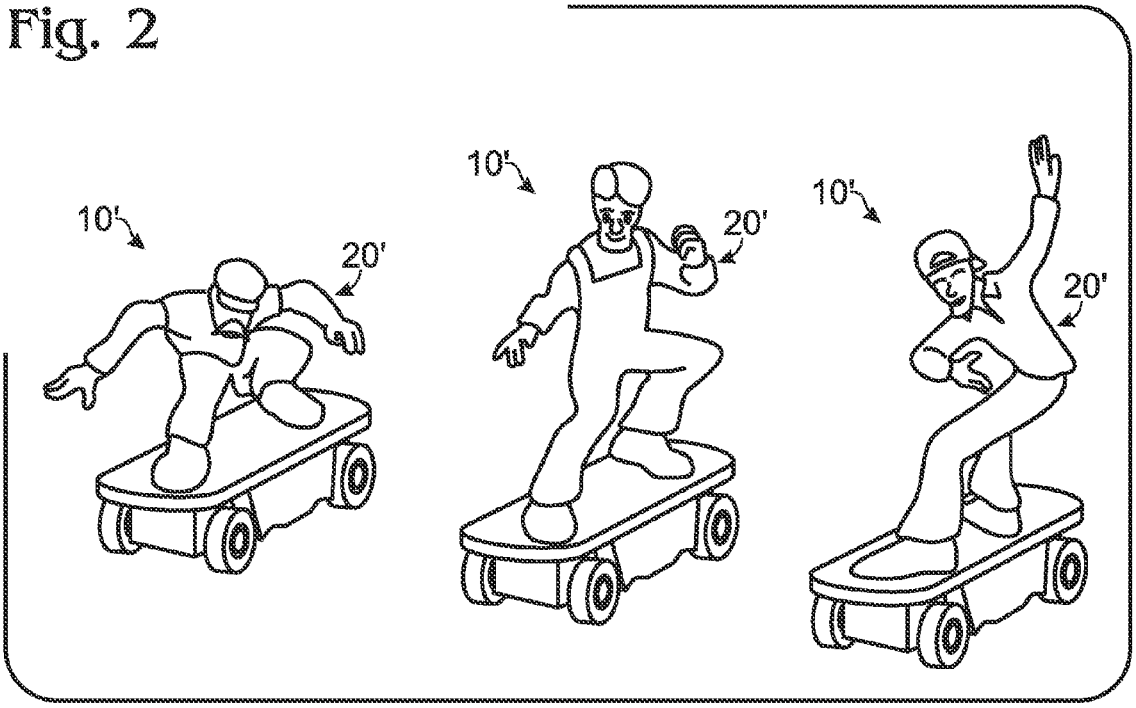
FIG. 2 is a perspective view of three wheeled toy vehicles according to the present disclosure.

FIG. 2, shows three examples of wheeled toy vehicles indicated at 10', all of which are configured similarly to wheeled toy vehicle 10, but having differently configured toy figures mounted to the chassis, indicated at 20'. Each toy FIG. 20' on toy vehicles 10 and 10' depicts a different skateboarder in a different pose. As used herein, the term "toy vehicle 10" may refer to any of the wheeled toy vehicles 10 and 10' as shown in the figures.

Other embodiments of wheeled toy vehicles according to the present disclosure, such as those based on a skateboarder theme, different themes, or no theme, may include multiple figures mounted to the chassis, or no figure, or structure that does not necessarily resemble a humanoid figure. Moreover, the chassis (with or without one or more figures mounted to the top surface) may be adapted to have any suitable appearance, such as to resemble any manner of wheeled (or non-wheeled) vehicle. As such, the appearance of the wheeled vehicle may be configured as desired, for example to leverage different product lines by assuming the overall appearance of a recognizable figure, or type of figure, riding in and/or on a vehicle.

In the illustrated examples, toy FIGS. 20 and 20' are securely mounted to the chassis and is configured to maintain a predetermined pose. However, in other examples, such figures may be poseable or otherwise adjustable, for example to allow a user to manipulate a figure to assume a desired configuration and/or to change the center of gravity or weight distribution of the wheeled vehicle, which may in turn result in different movement behavior of the vehicle as it moves over a surface or through the air, as explained in greater detail below. Optionally, in such examples, a figure may be selectively removable from the chassis, for example to allow a user to mount a desired figure to a chassis or exchange a figure with another one, to change the center of gravity and/or weight distribution as explained above, and so forth.

The particular poses and other configurational variants of the various toy figure embodiments may optionally impact the aerodynamics of the toy vehicle as it moves over a surface or through the air. The different aerodynamic nature of each embodiment of the toy vehicle may cause the different toy vehicle embodiments to perform different tricks.

Returning to FIG. 1, but as may also be seen in FIG. 2, wheels 18 of toy vehicles 10 are configured to allow the vehicles to travel across a surface. Wheels 18 in the illustrated examples are freely rotatable and mounted in a fixed alignment to allow the vehicles to roll in one of two predetermined rolling directions, indicated in FIG. 1 with bidirectional arrow A. In other words, the wheels 18, which may be considered to include a front pair of wheels 22 and a rear pair of wheels 24, are aligned to roll the vehicle either forward (i.e., in the direction of front pair of wheels 22) or backward (i.e., in the direction of rear pair of wheels 24).

In the illustrated embodiments, wheels 18 are freely rotatable, and thus the vehicle may be rolled along a surface in response to a force imparted to the vehicle, such as being pushed by a user, rolled down an inclined surface, launched from a mechanical launcher, and so forth.

Figure 3:
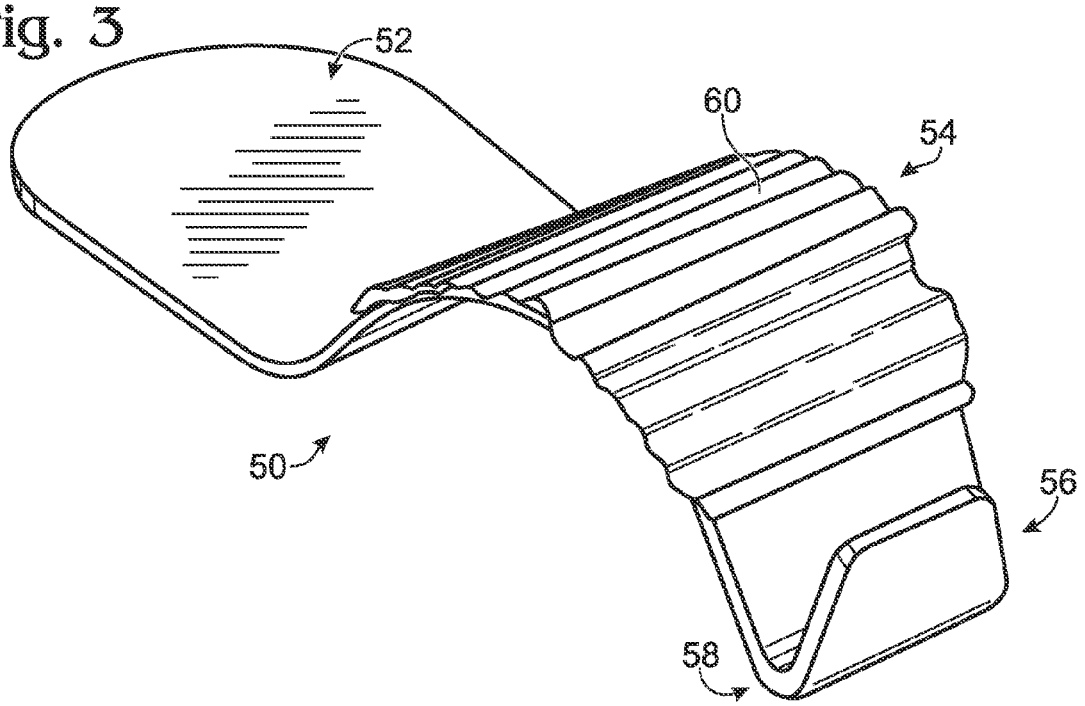
FIG. 3 is a perspective view of a launcher suitable for use with the wheeled toy vehicles of the present disclosure.
Figure 4:
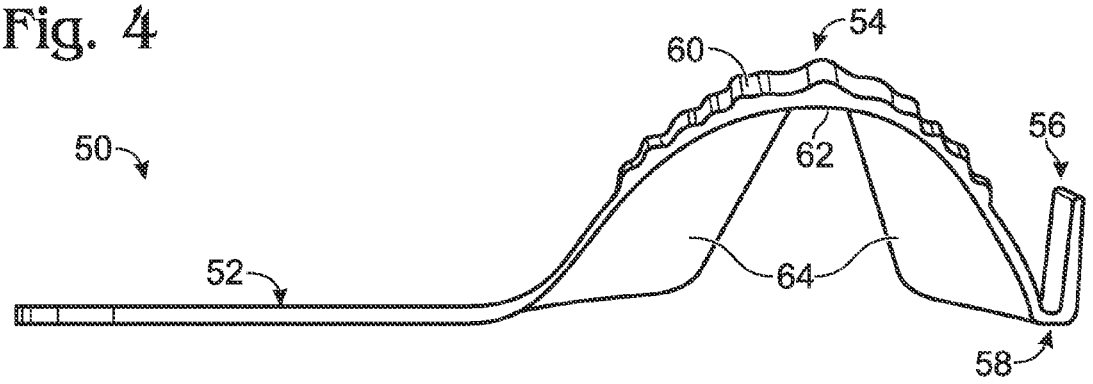
FIG. 4 is a side view of the launcher of FIG. 3.

FIGS. 3 and 4 show an example of a launcher 50 consisting of an elongate, resilient, and generally flat piece of material with a flat support end 52, a concave energizer portion 54 that curves upward from support end 52 and then downward again to terminate in a bumper portion 56 that includes a short tab that curves sharply upward from a surface-contacting slide portion 58.

Launcher 50 includes a top surface 60, a portion of which is shaped as a curved piece of corrugated metal such that the launcher somewhat resembles an overturned trash can. The launcher may be configured to have any desired decorative features, but the corrugated portion may function to allow the launcher to be more easily used by a user pressing down on the energizer portion, as explained below. As seen in FIG. 4, bottom surface 62 of launcher 50 includes two flat bracing portions 64 extending downward from the energizer portion, the bracing portions being configured so that when the launcher is placed with the bottom surface against the ground or other flat support surface, the bottom edges of the bracing portions are spaced above the ground. Also, although not shown in this view, bottom surface 62 of the support end 52 may be textured or otherwise adapted for increased friction against the ground or flat support surface.

In use, the launcher may be placed with the bumper adjacent to a wheeled figure such as wheeled toy vehicle 10, and energized to direct energy imparted to the launcher to be transferred to the toy vehicle. More specifically, the energizer portion may be pressed sharply downward, which causes the launcher to deform longitudinally, moving the slide portion outward and extending the bumper, imparting a lateral force to the adjacent toy vehicle. The bracing portions may limit the amount of deformation of the energizer portion by abutting the ground and/or otherwise stabilizing the launcher against damage or breakage from receiving a sudden, downward force. For additional stability, a user may press downward on the support end to steady the launcher while striking downward on the energizer portion to launch a toy vehicle. The resilient nature of the launcher material allows the launcher to return to its original configuration after use.

Of course, any suitable launcher or launching mechanism may be used with the toy vehicles, including a gravity feed and/or magnetic forces, in addition to or instead of mechanical devices, such as launcher 50.

Optionally, one or more wheels of a wheeled toy vehicle may be driven, such as by a motor. One or more of the wheels (including one or more driven wheels) may be steerable, such as to allow a user to select a direction of travel for the vehicle other than the rolling direction determined by the arrangement of wheels 18.

In other embodiments of the wheeled toy vehicles according to the present disclosure, the wheels may be arranged on the chassis to provide the wheeled vehicle with a desired degree of stability, for example to facilitate different play patterns, such as play patterns which a user attempts to keep a wheeled figure upright as it travels along a surface, traverses a shaped section of pathway, engages a surface after being propelled through the air, and so forth. As such, the wheels of each pair may be placed closer together or further apart, and the distance between the pairs of wheels may similarly be adjusted, relative to the configuration illustrated in the figures. Optionally, a chassis may be provided with more or fewer than four wheels.

Figure 5:
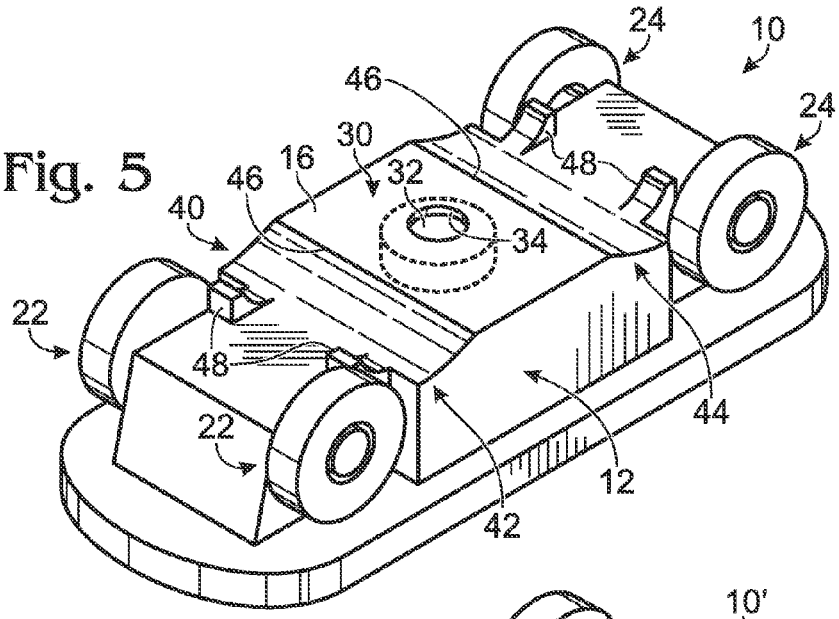
FIG. 5 is a perspective view of the bottom surface of the toy vehicle of FIG. 1.

Returning to FIGS. 1 and 2, but with additional reference to FIG. 5, the bottom surface of the wheeled vehicle 10 includes a magnetic portion 30, shown in the illustrated embodiment to include a disk-shaped magnet 32 housed within chassis 12. Magnet 32 is partially visible through a circular aperture 34, the inner lip of which overlaps the edge of the magnet.

Figure 6:
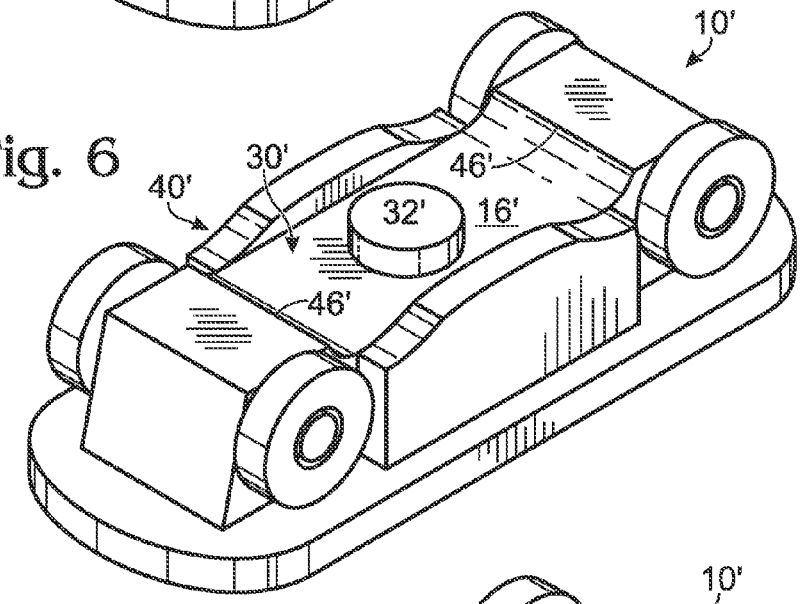
FIG. 6 is a perspective view of an alternative embodiment of the bottom surface of a wheeled toy vehicle according to the present disclosure.
Figure 7:
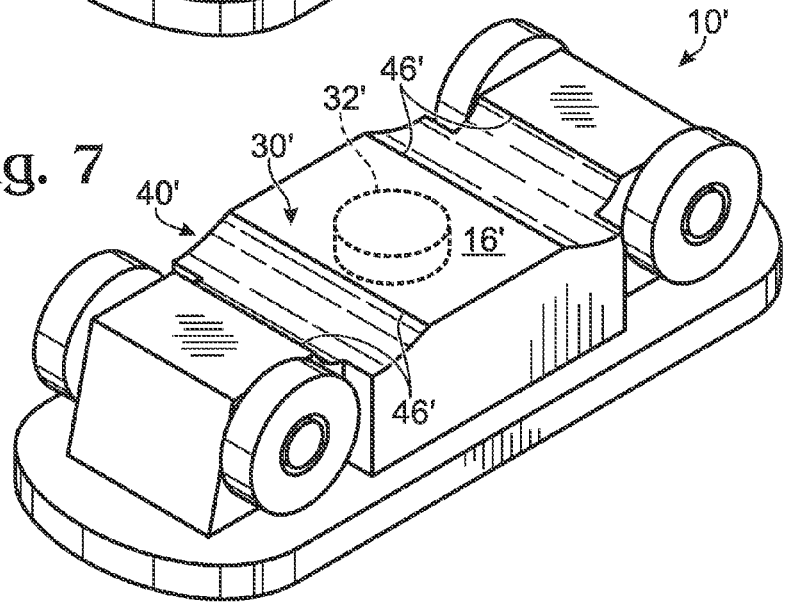
FIG. 7 is a perspective view of another alternative embodiment of the bottom surface of a wheeled toy vehicle according to the present disclosure.

However, any suitable mounting method may be used; two non-limiting variants are shown in FIGS. 6 and 7. In FIG. 6, for example, a toy vehicle 10' includes a magnetic portion 30' that includes a magnet 32' positioned on (or partially recessed within) bottom surface 16'. In FIG. 7, a toy vehicle 10' includes a magnetic portion 30' that includes a magnet 32' wholly encased within chassis 12'. Optionally, any suitable magnetic material may be used, such as a metallic magnet, a vinyl or plastic material impregnated with magnetic powder, and so forth. Magnetic portion 30 (and 30') is positioned and/or configured on bottom surface 16 of chassis 12 so that the top surface may be non-magnetic, or magnetic, as desired.

The magnetic portion 30 (and 30') may be configured to have a desired magnetic force or strength, for example to allow the wheeled vehicle to attract, or be attracted to, a metallic surface or other suitable material. In the illustrated examples, the magnetic portion of toy vehicle 10 is adapted to adhere or "stick" to such a material, and repel (and be repelled away from) another magnet or any other suitable material. As a result, the wheeled vehicles may interact with a play set that includes magnets and magnetic surfaces to perform certain stunts, such as sticking, sliding or riding in a vertical or an upside down position, and sliding along or sticking to a pipe, ramp, rail, and so forth. Some examples of play sets are discussed in more detail below.

Returning to FIGS. 1 and 2, and with additional reference to FIG. 5, bottom surface 16 also includes groove-defining structure 40 that is configured to define a pair of substantially parallel grooves 42, 44 across the bottom surface of the chassis. Each of grooves 42, 44 are shown to be positioned adjacent to a pair of wheels 18, and have a substantially concave profile relative to the bottom surface. More specifically, groove 42, which may be referred to as a front groove, is positioned adjacent to front pair of wheels 22, and groove 44, which may be referred to as a rear groove, is positioned adjacent to rear pair of wheels 24. As such, the grooves are configured, for example, to provide a sliding surface for movement of the toy vehicle along a corresponding parallel set of raised rails, ridges, bars, or similar structure. Accordingly, the material from which the bottom surface is fabricated may be selected or configured to have a low friction force, such as to facilitate sliding motion along such structure.

As shown in FIG. 5, the groove-defining structure for each of grooves 42, 44 of wheeled vehicle 10 includes a continuous shaped rim 46 on one side of the groove and a pair of shaped tabs 48 on the other side. As such, although the groove-defining structure is discontinuous across the bottom surface of the chassis (and, accordingly, the cross-section of the groove-defining structure is not constant across the bottom surface of the chassis), the groove has a concave (relative to the bottom surface) profile, as is visible from a side view of the toy vehicle such as those shown in FIGS. 1 and 2.

Other configurations of groove-defining structure are possible and within the scope of the disclosure. Again, FIGS. 6 and 7 show two non-limiting variants as examples. In FIG. 6, for example, toy vehicle 10' includes groove-defining structure 40' having a continuous shaped rim 46' on one side of each groove, and a pair of opposing ridges each with inwardly curved ends disposed on each side of the chassis between the front and rear wheels, each corresponding pair of curved ends on each ridge forming groove-defining structure 40' on the other side of each groove. FIG. 7 shows another example in which toy vehicle 10' includes groove-defining structure 40' having a pair of opposing continuous shaped rims 46' on either side of each groove, such that the groove-defining structure extends continuously across the bottom surface of the chassis.

In other examples consistent with and according to the present disclosure, the groove-defining structure 40 (and grooves defined thereby) may be arranged on the bottom surface to provide the wheeled vehicle with a desired degree of stability, for example, when the vehicle is placed for slidable movement on a pair of parallel rails or similar structure. For example, although the illustrated toy vehicles are shown to include a pair of grooves disposed between the front and rear pair of wheels, with each groove positioned adjacent to a pair of wheels, different configurations of the grooves, which may facilitate different play patterns, such as with different configurations of the wheels, are within the scope of this disclosure.

Also, although the grooves of the illustrated toy vehicles are shown to extend in a direction generally at right angles to the rolling direction of the vehicle, other embodiments according to this disclosure may include one or more pairs of parallel grooves extending in any desired direction, including directions different from, or the same as, the rolling direction. Such variations are considered to be within the scope of this disclosure.

As mentioned above, the magnetic portion, the wheels, and the grooves of the wheeled figures, may interact with play sets that include various features such as corresponding magnetic portions, surfaces adapted to engage the plurality of wheels for rolling movement of the toy vehicle thereon, structure adapted to engage the grooves on the bottom surface of the toy vehicle for slidable movement of the toy vehicle thereon, and so forth. The following paragraphs disclose several example playsets incorporating various combinations of such features.

Figure 8:
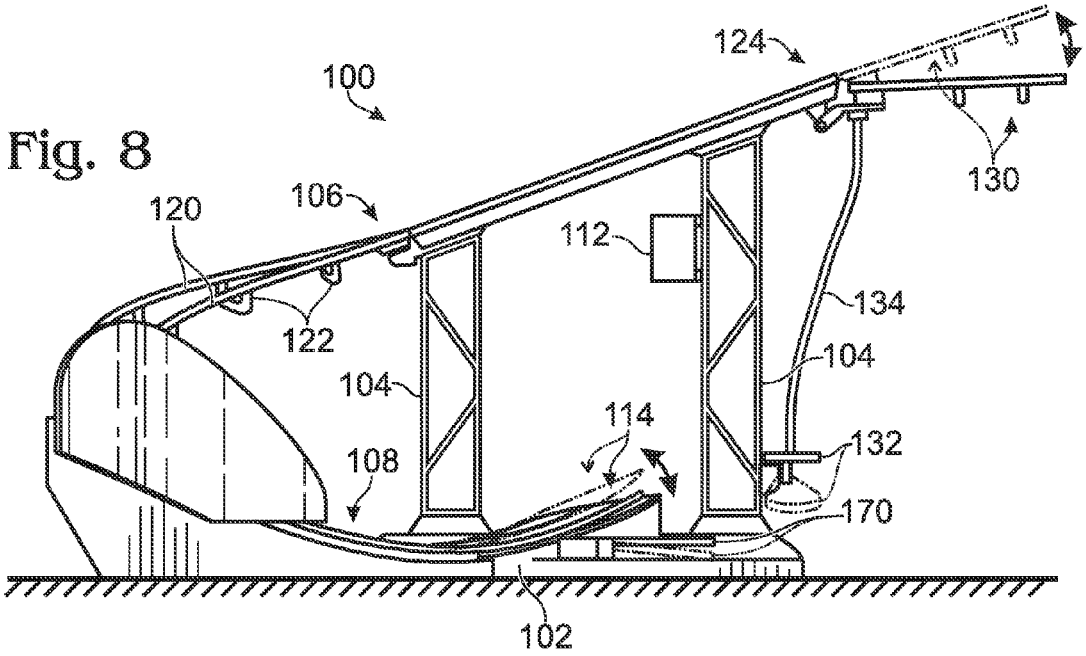
FIG. 8 is a front elevation view of a first example playset suitable for use with the wheeled toy vehicles of FIGS. 1 and 2.
Figure 9:
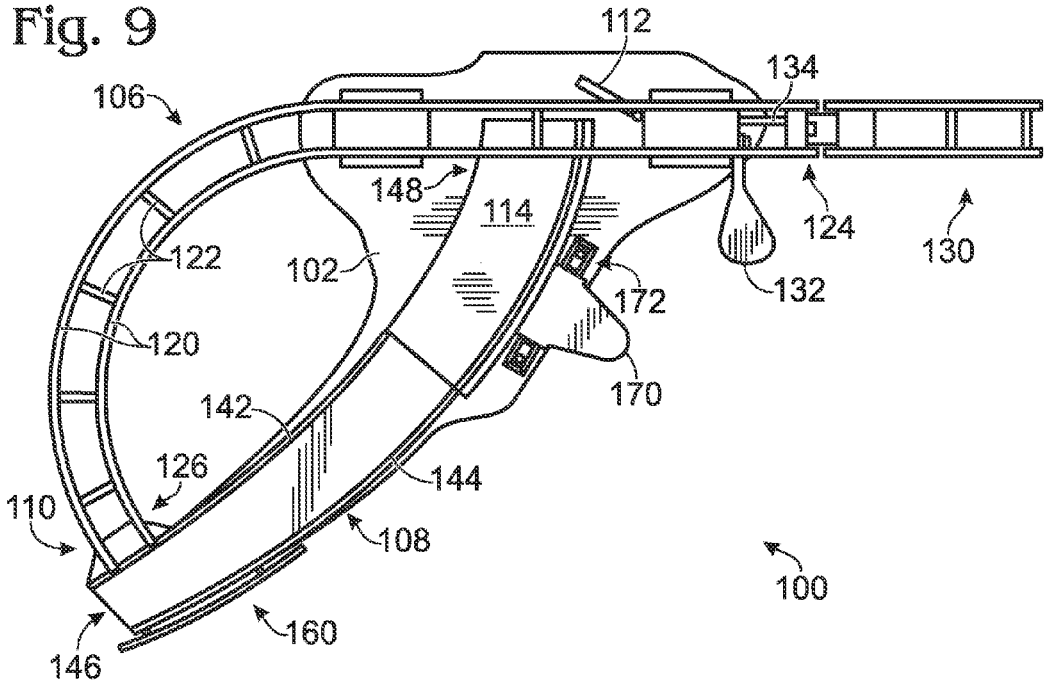
FIG. 9 is a top view of the playset of FIG. 8.
Figure 10:
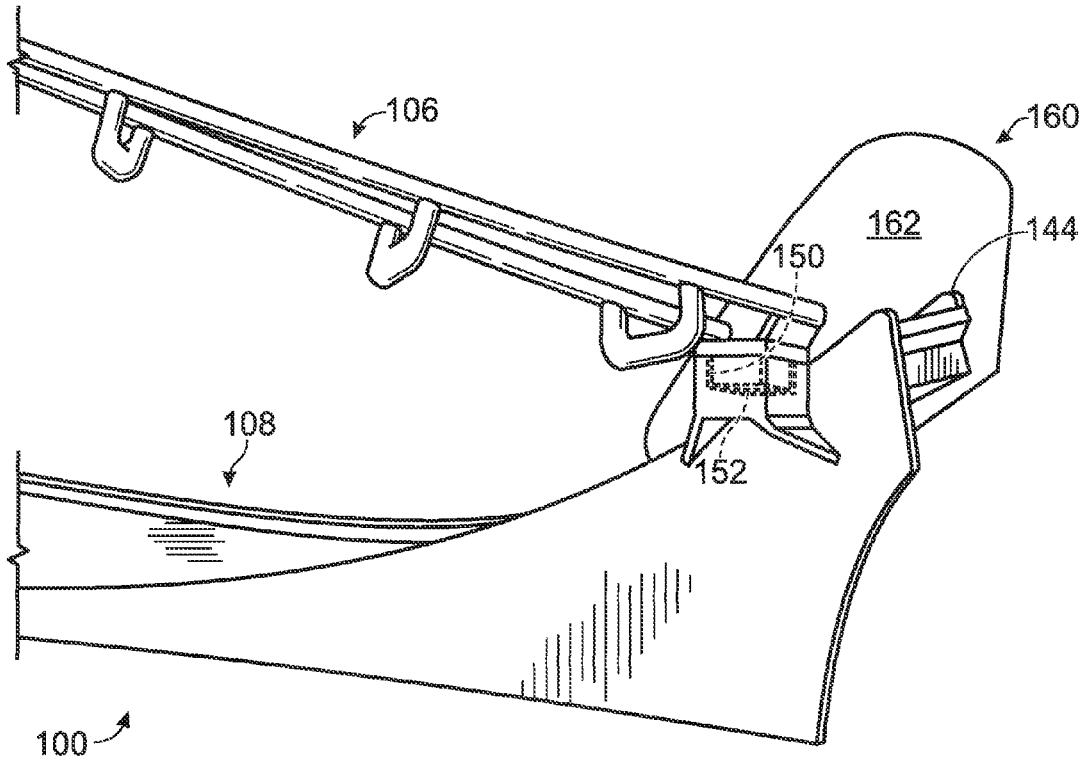
FIG. 10 is a detail of a side view of the playset of FIG. 8.

FIGS. 8-10, for example, shows a first playset 100 that includes a base 102, a pair of support portions 104 supporting a first track section 106 at an incline with respect to the base, and a second track section 108 coupled to the first track section via connecting portion 110. Playset 100 also includes a target 112 disposed on one of the support portions 104, and a selectively actuable ramp portion 114 configured to launch a toy vehicle from the second track section toward the target. First track section 106 is shown to be designed to have the overall appearance of a "grind rail," and second track section 108 resembles a ramp, and several decorative components of the playset are consistent with the skateboarder theme of illustrated examples of wheeled toy vehicles 10; however, the decorative components of the playset may be varied in other embodiments to further a different theme (or themes), or no theme.

First track section 106 is adapted to engage the grooves on the bottom surface of the toy vehicle for slidable movement of the toy vehicle thereon, and is shown in FIG. 5 as a pair of parallel bars 120 connected by a plurality of spaced ties 122, although other configurations are possible. First track section 106 is shown to slope downward from an upper first end 124 and then to tilt slightly and curve before terminating in a lower second end 126. Near first end 124, first track section 106 also includes a selectively actuable launch portion 130, shown as a shorter length of track section hingedly connected to the first end of the track section.

Launch portion 130 may be raised by pressing first actuator 132, which raises the launch portion via a lever mechanism 134. FIG. 8 shows launch portion 130 in an "at-rest" position in solid lines, and in a raised position in dashed lines. First actuator 132 is also shown in an "at-rest" position in solid lines, and in a lowed position (corresponding with the raised position of launch portion 130) in dashed lines.

Second track section 108 is adapted to engage the plurality of wheels of the toy vehicle for rolling movement of the toy vehicle thereon, and is shown in FIG. 9 as a generally planar surface 140 disposed between opposing guard rails 142, 144, although other configurations are possible. Surface 140 and guard rails 142, 144 collectively form a slightly curved, shaped pathway leading generally downward from an upper first end 146 to a lower second end 148 and toward the base.

Connecting portion 110 is shown in dashed lines FIG. 10 as a slot 150 configured to receive a corresponding downwardly extending tab 152 (also shown in dashed lines) on the lower second end 126 of first track portion 106. However, other embodiments according to the present disclosure may include any structure suitable to couple the track portions.

In playset 100, first track portion couples with second track portion at a right angle, but other configurations may include coupling track portions in any manner suitable for the second track portion to receive a toy vehicle from the first track portion. Playset 100 also includes a directing portion 160 disposed near the junction at which first track portion couples with second track portion, the directing portion being adapted to direct the toy vehicle from the first track portion to the second track portion while maintaining the toy vehicle in an upright position. As can be seen in FIG. 10, directing portion 160 includes a vertically disposed surface 162 adjacent to the second track section, the vertically disposed surface 162 being substantially coplanar with the portion of the guard rail 144 adjacent the junction of the two track portions.

Ramp portion 114 is shown disposed near second end 148 of the lower track section, and configured to be selectively actuable to launch a toy vehicle from the lower track section toward target 112. As shown in the illustrated embodiment, second actuator 170 is configured to raise ramp portion into an upwardly-inclined position (shown in dashed lines in FIG. 8) via a lever mechanism 172.

Target 112 is shown to be mounted to a support portion 104 and positioned so that a toy vehicle launched from the ramp portion may strike the target, for example if a user presses the second actuator 170 at an appropriate time. Moreover, target 112 of playset 100 is magnetically attractive, such that a toy vehicle correctly launched toward the target may strike and stick to the target. In some embodiments, target 112 may be provided with a switch or other mechanical or electrical components so that striking the target may prompt the playset to emit an output, such as incrementing a score, producing a visual and/or audio display, and so forth.

In use, a wheeled toy figure, such as toy FIG. 10 as described above, may be placed on the launch portion 130, with the figure's grooves positioned to engage the parallel bars of the first track section 106. First actuator 132 may be depressed, raising launch portion 130 into an inclined position, which forms a gravity feed for the toy vehicle, which may accordingly begin to slide from the launch portion to the first end of first track section 106, and then traverse the curved incline of first track section 106.

First track section 106 is shown to be configured so that a toy vehicle moving along the track section will gain momentum as it moves to the lower end. The toy vehicle will be moving on the first track portion "sideways" with respect to the rolling direction of the wheeled vehicle while engaging the parallel bars of the track section, and when it exits the lower end of the first track section and moves on to the upper end of the second track portion, at which point it will engage directing portion 160. The vertically disposed surface 162 prevents the figure from tipping over or falling off the track, and maintains the toy figure in an upright position and in a suitable orientation to roll down the second track portion toward the base.

An example play pattern for use with the playset, after a toy vehicle slides along the the first track section and rolls down the second track section, may include a user attempting to stick the toy vehicle to target 112 by correctly gauging the velocity and timing of the toy vehicle as it travels over the ramp portion 114, and by depressing second actuator 170 to launch the toy vehicle at the target. If the user misses the target, or fails to strike the target with the toy vehicle in such a manner as to allow the magnetic bottom surface of the vehicle to adhere to the magnetically attractive target, the user may place another toy vehicle on the launch portion 130. However, many other play patterns are possible.

Also, the illustrated configuration is only an example of a playset suitable for use with a wheeled toy vehicle such as toy vehicle 10. Accordingly, it can be seen that other configurations, for example those including multiple track portions and/or in which the track portions are arranged differently, may include differently configured components, such as a directing portion that includes any structure suitably positioned and otherwise configured to maintain a toy vehicle upright as it moves from one track portion to another. In any embodiment, the coupling portion(s) and the directing portion(s) may be incorporated into one or more of the various track portions, or may be separate structure. The track portions themselves may be of unitary construction, or may include several separable components which may be assembled into one or more track portions, and may be fabricated of any suitable material (or materials), for example so that the track sections may have a desired degree of flexibility or rigidity.

Other playsets incorporating the components and concepts above may include any manner and/or combination of track sections configured to engage the grooves and/or the wheels of a toy vehicle for movement of the toy vehicle thereon. Optionally, other playsets may include different configurations of one or more magnetic components. For example, although playset 100 is indicated to include a magnetically attractive target, other embodiments may include magnetic components configured to repel, rather than attract, the magnetic portion of a wheeled toy vehicle. Still other embodiments may include combinations of magnetically attractive and repulsive components. All of such variants are considered to be within the scope of this disclosure.

Figure 11:
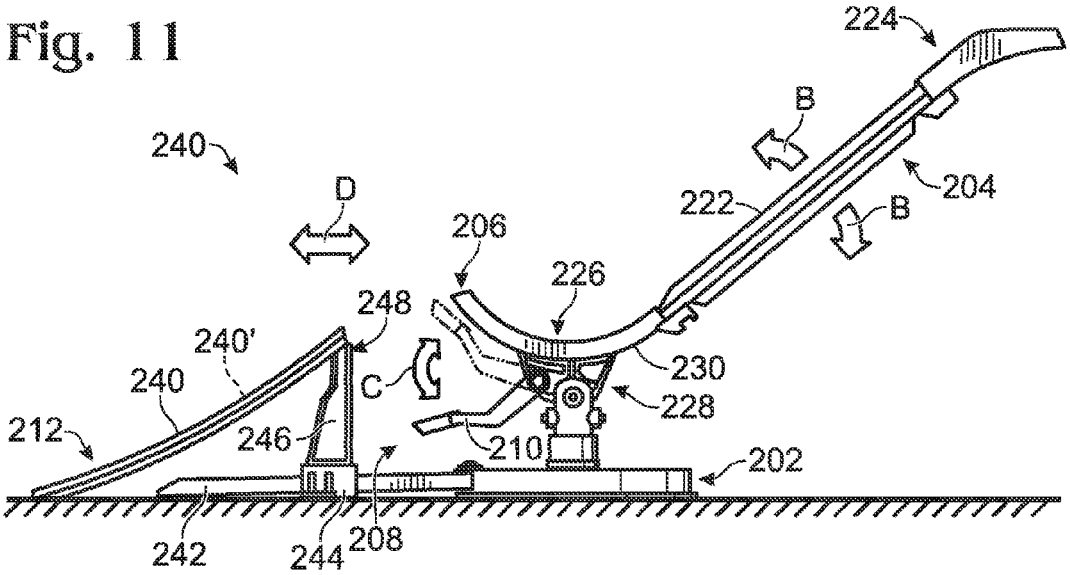
FIG. 11 is a side elevation view of a second example playset suitable for use with the wheeled toy vehicles of FIGS. 1 and 2.
Figure 12:
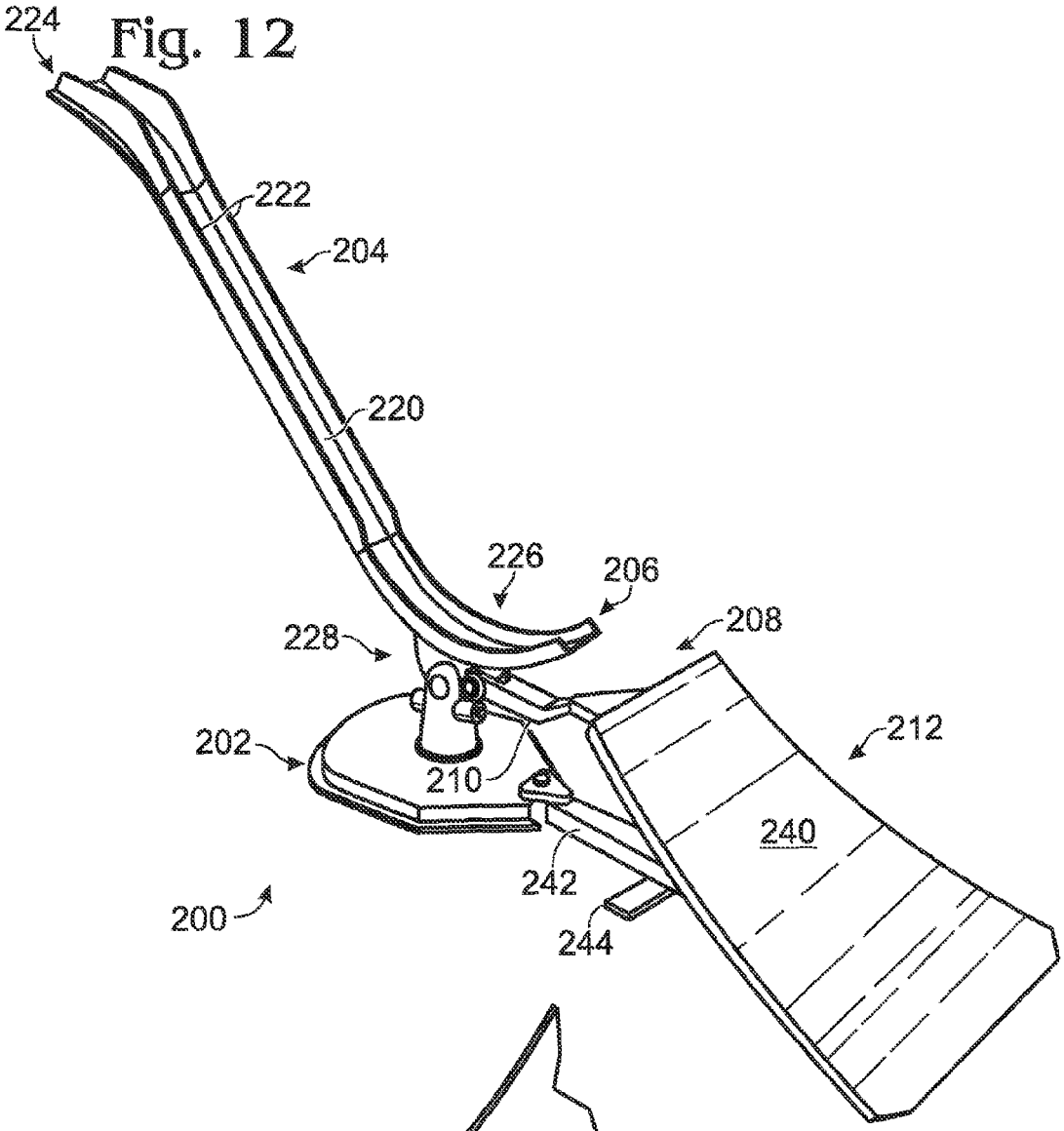
FIG. 12 is a perspective view of the playset of FIG. 11.

An example of a playset that includes a magnet adapted to repel the magnetic portion of a wheeled toy vehicle such as toy vehicle 10 is shown in FIGS. 11 and 12 as second playset 200. Playset 200 is shown to include a base 202, a launch ramp 204 that includes a jump lip 206, and a magnetic element 208 shown to be coupled to an adjustable arm 210. Playset 200 is also shown to include a landing ramp 212.

As can be seen in FIG. 12, launch ramp 204 includes a substantially planar surface 220 disposed between opposing guard rails 222, which collectively form a shaped pathway leading generally downward from an upper end 224 to a lower end 226 that includes an upwardly-inclined section terminating in jump lip 206. Launch ramp 204 is thus shown to be adapted to engage the plurality of wheels of, for example, toy vehicle 10, for rolling movement of the toy vehicle thereon. However, as discussed above, other configurations are possible. For example, other embodiments of a launch ramp may include rails or bars or other structure adapted to engage the grooves of toy vehicle 10, alternatively or in addition to a ramp section adapted for rolling movement. For example, an alternative configuration similar to playset 200 may include parallel guard rails that, in addition to providing a shaped rolling pathway, are configured to engage the grooves on the bottom surface of toy vehicle 10 to provide a sliding pathway.

Launch ramp 224 of playset 200 is tiltably mounted to base 202, by means of a support framework 228 that extends from a lower surface 230 of the launch ramp. As shown, the launch ramp of playset 200 defines a substantially vertical plane, and the launch ramp is tiltable with respect to the base within the vertical plane. In other words, the incline of the launch ramp with respect to the base may be adjusted by pivoting the launch ramp back and forth, as indicated by directional arrows B. Other embodiments, however, may include structure to allow the launch ramp to be movable in other dimensions, and/or for portions of the launch ramp to be twisted or bent in a configuration other than that shown in FIGS. 11 and 12. For example, in some embodiments, the jump lip may be flexible or moveable to direct a toy vehicle traversing the launch ramp in a direction to either side of the vertical plane defined by the jump ramp.

The adjustable arm 210 is shown to pivotably extend from the support framework and configured to be selectively positionably with respect to the jump lip, as indicated by directional arrow C. The configuration and/or position of the magnetic element 208 may alter the flight path of a toy vehicle launched from the jump lip after rolling down the launch ramp, due to the magnetic repulsion or attraction of the magnetic element to the magnetic portion of the toy vehicle. Thus, adjusting the position of the arm may allow a user to determine the extent to which the magnetic element interacts with a toy vehicle at or near the jump lip. For example, a user may position the magnetic element substantially adjacent to the jump lip (shown in dashed lines in FIG. 11), for greater overlap of the magnetic fields generated by the magnetic element and a toy vehicle at the jump lip, or may position the magnetic element away from the jump lip sufficiently to minimize magnetic interaction (shown in solid lines in FIG. 11), as desired.

In the embodiment illustrated in FIGS. 11 and 12, the magnetic element is adapted to repel the magnetic portion of the bottom surface of a wheeled toy vehicle such as toy vehicle 10. As such, positioning the magnetic element adjacent or near the jump lip may result in the toy vehicle performing a flip after being launched from the jump lip, due to the interaction of the magnetic fields.

As shown, the adjustable arm is moveable within a range of positions within the vertical plane defined by the launch ramp. More specifically, the magnetic element may be moved from immediately beneath the jump lip to further beneath the jump lip (to a position in which the magnetic field generated by the magnetic element does not substantially overlap the jump lip). However, other embodiments may include one or more magnetic elements moveable in several ranges relative to the jump lip, which may in turn allow a user to manipulate the various magnetic fields generated thereby to cause a toy vehicle launched from the jump lip to perform an array of aerial stunts, including simultaneous flipping and turning of the toy vehicle.

Playset 200 is shown to include landing ramp 212, having a downwardly-inclined surface 240 configured to receive a toy vehicle launched from the launch ramp. Landing ramp 212 is shown to be coupled to base 202 via a guide track 242, with which the bottom portion 244 of a column 246 is slidably engaged. A top portion 248 of the column supports the landing ramp relative to the guide track. Although other configurations are possible, this configuration allows the landing ramp to be selectively positionable relative to the jump lip, as indicated by directional arrow D, for example to allow a user to move the landing ramp into a position in which a toy vehicle launched from the jump lip will engage the downwardly-inclined surface 240.

In the illustrated example playset 200, the surface is non-magnetic, allowing a toy vehicle engaging the surface to freely roll (or tumble, slide, or otherwise move) down the surface. However, in other examples, at least a portion of the surface may be configured to be magnetically attractive. Such a surface portion is indicated in FIG. 11 as 240'. Surface portion 240' may be magnetically attractive to the extent that rolling movement of the toy vehicle on the landing ramp may be slowed or completely arrested, allowing a user who correctly launches a toy vehicle onto the landing ramp to simulate a skateboarder "sticking" its landing. For example, a portion of the landing ramp may be made of a metal- or magnet-impregnated flexible plastic.

Also, in the illustrated embodiment, guide track 242 is coupled for pivotable movement in a lateral direction relative to base 202, for example to allow a user to move the landing ramp such that a toy vehicle launched from the jump lip will not engage the landing ramp. In embodiments in which portions of the launch ramp and/or the jump lip may allow a toy vehicle to be launched to either side of the launch ramp, lateral positioning of the landing ramp may enable a user to position the landing ramp to effect a landing.

As suggested above, play patterns suitable for use with playset 200 may include a user first adjusting various components of the playset, for example placing the landing ramp in a desired position, moving the magnetic element to a desired proximity relative to the jump lip, and tilting the launch ramp to have a desired incline with respect to the base, and so forth. The user may then place a toy vehicle, such as wheeled toy vehicle 10, at the upper end of the launch ramp to roll downward under the force of gravity. Depending on the position of the magnetic element, magnetic forces may or may not affect the aerial behavior of the toy vehicle when launched from the jump lip, and the toy vehicle may strike or otherwise engage the landing ramp.

Figure 14:
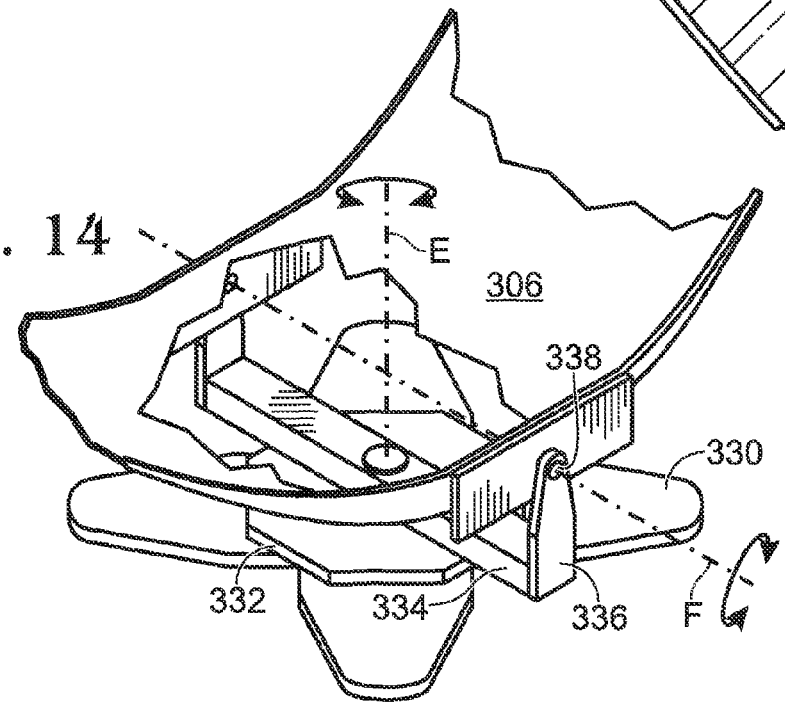
FIG. 14 is a partial view of an alternative configuration of the playset of FIG. 13, with a cutaway portion to show the base.
Figure 13:
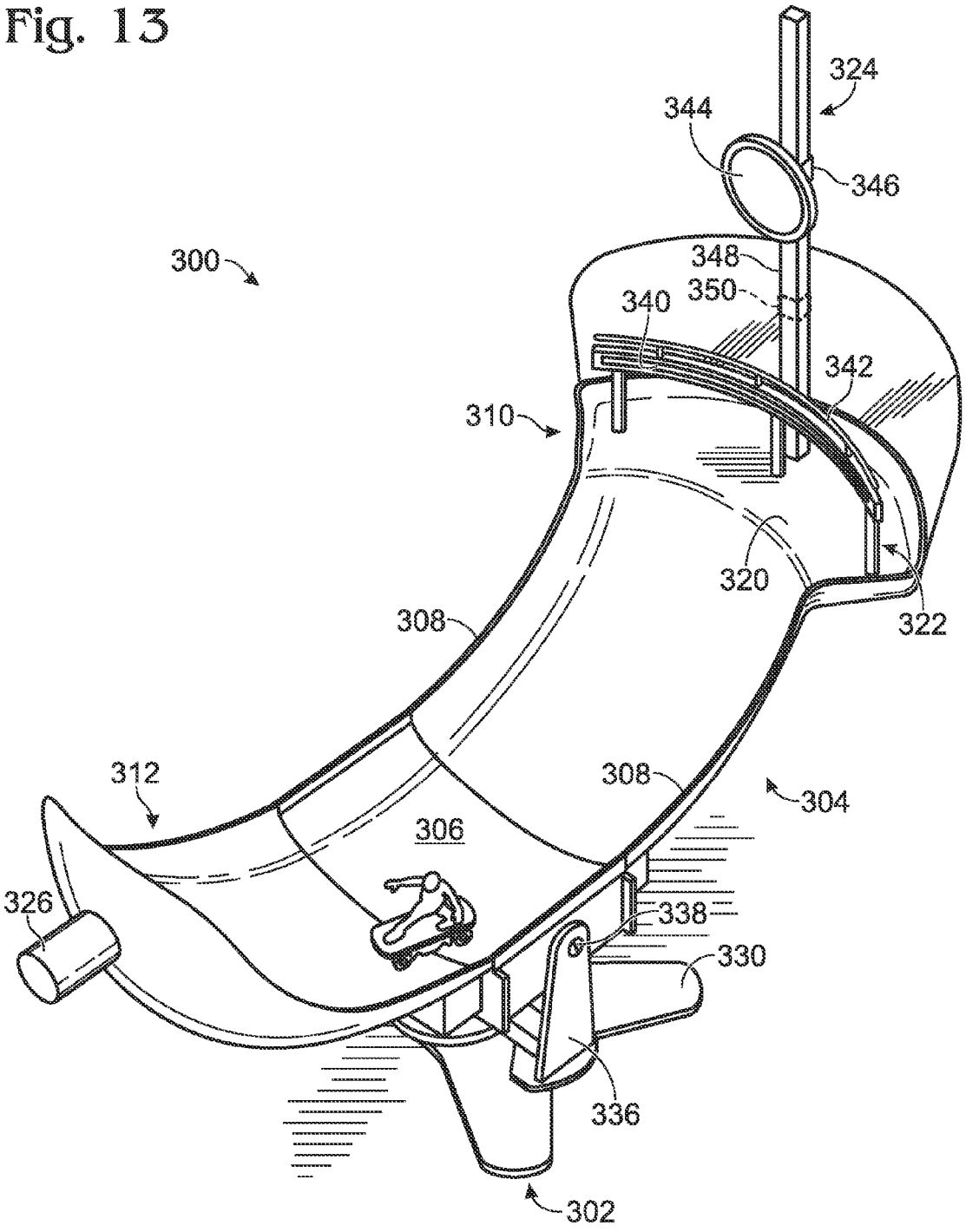
FIG. 13 is a perspective view of a third example playset suitable for use with the wheeled toy vehicles of FIGS. 1 and 2.

A third example playset 300 suitable for use with toy vehicles such as wheeled toy vehicle 10 is shown in FIGS. 13 and 14. Third playset 300 is shaped to generally resemble a "half-pipe," for example to further the skateboarder theme of the illustrated example toy vehicles and may allow for aerial jumping. Playset 300 includes a base 302 to which is tiltably mounted a half-pipe structure 304 which includes a generally flat and oblong central area 306 that curves upward to form side walls 308 and opposing bowl-shaped ends including a first end 310 and a second end 312. First end 310 includes a flat deck portion 320 upon which is mounted a grind rail 322 and an adjustable target 324. Second end includes a counterweight 326 disposed on the outside surface of the half-pipe structure.

Although other configurations are possible, FIG. 14 shows base 302 supporting half-pipe structure by means of a flat support 330 to which is coupled a turntable 332, upon which is mounted a cross brace 334 that includes two vertical arms 336. Arms 336 at their upper ends engage pivot pins 338 extending from either side of the half-pipe structure 304. As such, base 302 allows half-pipe structure 304 to be turned from side to side on turntable 332, as indicated by axis E. The half-pipe structure to be tilted back and forth, with upper ends of arms 336 acting as a fulcrum and generally defining a pivot axis indicated at F.

The inner surface of half-pipe structure 304 is shown to be continuous and smooth, and thus configured to allow a wheeled toy vehicle, such as toy vehicle 10, to roll on the inner surface, as shown in FIG. 13. During play, a user may place one or more wheeled vehicles on the inner surface of the half-pipe structure and tilt it back and forth, side to side, or in any direction on the pivot to impart motion to the toy vehicle in the structure. In some play patterns, a goal may be to impart sufficient force to a toy vehicle, either by moving the half-pipe structure and/or suddenly arresting movement of the structure, that the momentum of the toy vehicle may flip it from the inner surface. Depending on the movement of the structure and the toy vehicle, the toy vehicle may jump out and return to the wall of the half-pipe, may be propelled toward either the grind rail 322 or the target 324, and so forth.

In the illustrated example playset 300, the grind rail 322 includes a magnetic strip 340 along the front surface of the rail and a metallic lip 342 along the top surface of the rail. Both the magnetic strip and the metallic lip may be selectively removed from the grind rail. Also, the adjustable target includes a flat magnetic front surface 344 that extends from a brace 346, which slidably engages vertical post 348. As such, the various components mounted on deck portion 320 may function as targets for a user to attempt to strike, or "stick," by flipping a toy vehicle from the half-pipe structure.

Other playsets, including variants of playset 300, may include targets in different configurations and/or targets disposed at other positions relative to the half-pipe structure. Optionally, targets may be motorized or otherwise configured to be moveable. For example, the vertical post to which target 324 is mounted may be hinged or otherwise configured to move responsive to the movement of the half-pipe. Such a hinge device may be incorporated, for example, at 350. Also, as discussed above, one or more targets may be adapted to prompt the playset to emit an output responsive to the target being struck or a figure being stuck to the target.

Figure 15:
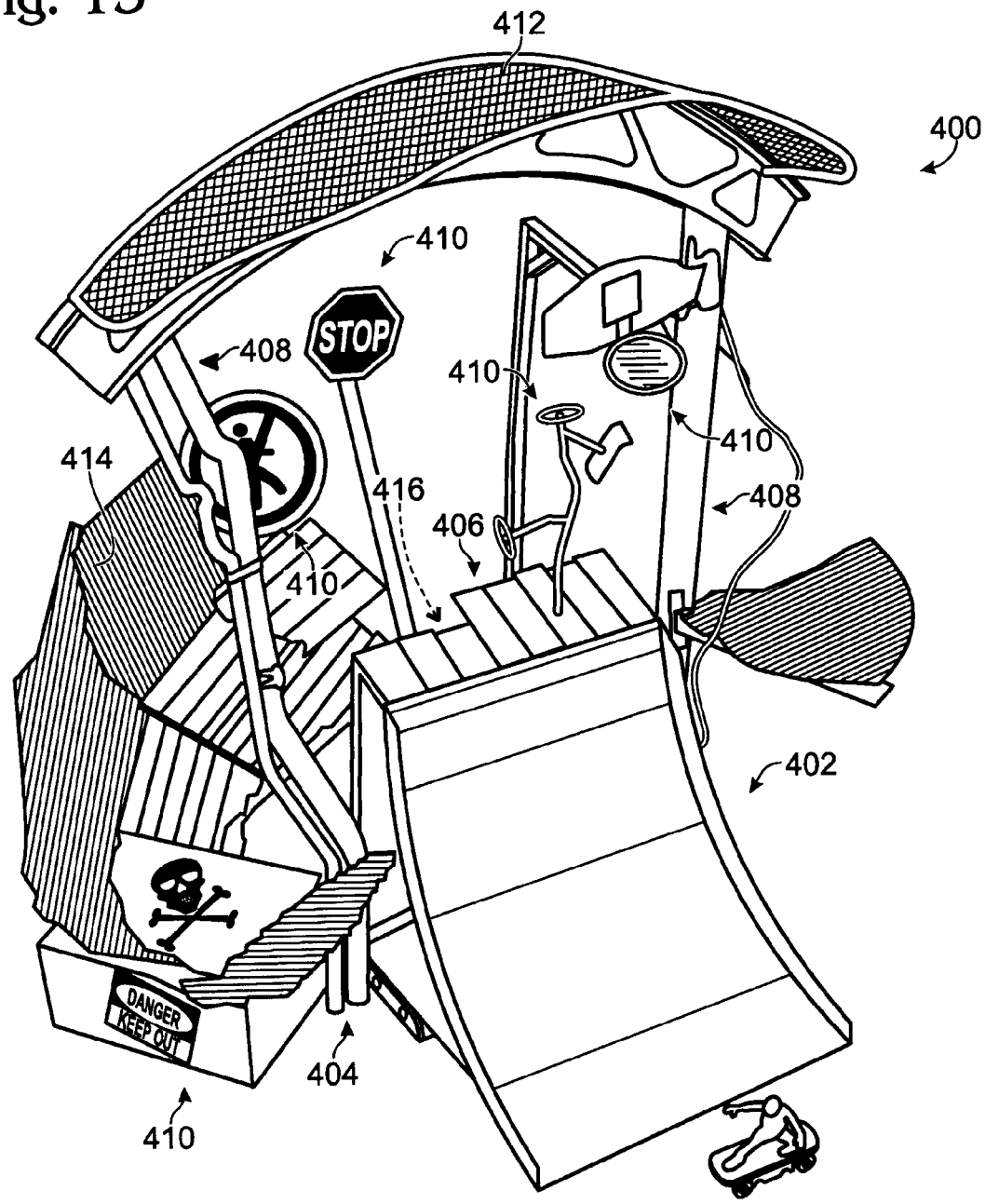
FIG. 15 is a perspective view of a fourth example playset suitable for use with the wheeled toy vehicles of FIGS. 1 and 2.

An example of a playset with multiple moveable targets is shown in FIG. 15 as playset 400 as a "quarter-pipe" ramp and an array of targets. More specifically, playset 400 is shown to include a ramp 402 mounted on a support structure, shown generally at 404. Support structure 404 also supports a generally horizontal deck portion 406 disposed at the upper end of the ramp 402. A rear mounting structure 408 extends upward from the deck portion. Arranged on the deck portion and the mounting structure are an array of targets 410. A top wall 412 and a rear wall 414 define general boundaries of the target area and may function to direct wheeled vehicles launched up the ramp toward the target, and/or prevent such wheeled vehicles from being propelled away from the playset.

In playset 400, deck portion 406 functions as a housing for circuitry and related electronic components, designated generally as electronic system 416. Several targets 410 are configured, when struck with sufficient force, to register a "hit" as input to the electronic system, which in turn emits a sound output or "payoff" corresponding to the target, such as via one or more speakers (not shown).

Any suitable means of registering a hit to the electronic system may be used. For example, targets 410 may each include a pair of spaced electrical contacts that may be urged together by a force such as that imparted by a toy vehicle striking the target, in turn prompting the electronic system to emit a corresponding output. Electronic system 412 may also configured to count the number of times each target is struck during a predetermined time interval, and output a sound indicative of the total number. Further, several of targets 410 may be assigned a different point value, which may relate to the relative difficulty of striking the target, such that electronic system 416 increments a total score corresponding to the point values of the targets struck during the predetermined time interval.

The various targets are configured to have the appearance of objects that may be found in a skate park or other outdoor setting used for skateboarding, such as traffic signs, a basketball hoop, a dumpster, and so forth. Several of the targets are magnetically attractive, such that a user may attempt to "stick" a toy vehicle, such as wheeled toy vehicle 10, to a target. The targets may be stationary, such as the dumpster-shaped target secured to rear wall 414, or moveable. Movement of moveable targets of playset 400 may therefore be responsive to imparted forces, such as from a wheeled figure striking the target or other portions of the playset. In other configurations of such a playset, movement of targets may be controlled, such as by one or more motors, which may in turn be coupled to the electronic system of the playset. Any desired configuration of targets may be used, as well as any desired configuration of electronic system.

During play, one or more users may propel a toy vehicle toward ramp 402, such as by use of launcher 50 or by any other method, with sufficient force to launch the toy vehicle from the top edge of the ramp toward one or more targets 410. If the toy vehicle contacts or sticks to a target, the target may prompt a sound payoff. If the toy vehicle misses, it may fall into the dumpster-shaped target, which may prompt a negative sound payoff.

Although the various embodiments and configurations of the present disclosure have been shown and described with reference to the foregoing operational principles and description, it will be apparent to those skilled in the art that various changes in form, detail, and combinations of various elements may be made without departing from the spirit and scope of the disclosure.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A play system, comprising:

a toy vehicle comprising:

a chassis having a top surface and a bottom surface, the bottom surface defining at least a first plane and including a pair of substantially parallel grooves across the bottom surface of the chassis and configured to provide sliding surfaces, wherein the grooves are both substantially outwardly concave relative to the first plane, and a plurality of wheels rotatably mounted to the chassis and configured to roll the chassis on a surface in a predetermined rolling direction, the predetermined rolling direction is substantially transverse to the pair of substantially parallel grooves; and a playset, comprising:

a first track section adapted to engage the grooves on the bottom surface of the toy vehicle for slidable movement of the toy vehicle thereon;

a second track section adapted to engage the plurality of wheels of the toy vehicle for rolling movement of the toy vehicle thereon; and a connecting portion to couple the first track section with the second track section.

2. The play system of claim 1, further including a toy figure mounted to the top surface of the chassis.

3. The play system of claim 1, wherein at least one of the pair of grooves extends continuously across the bottom surface of the chassis.

4. The play system of claim 1, wherein the plurality of wheels includes a front pair of wheels and a rear pair of wheels.

5. The play system of claim 4 wherein the pair of grooves is disposed between the front and rear pair of wheels.

6. The play system of claim 5, wherein each of the pair of grooves is positioned adjacent to one of the front and rear pair of wheels.

7. The play system of claim 1, wherein at least a portion of the bottom surface is magnetic.

8. The play system of claim 7, further including a magnet housed in the chassis.

9. The play system of claim 7, wherein the top surface of the chassis is non-magnetic.

10. The play system of claim 1, wherein the plurality of wheels include front wheels that rotate about a first axis, and rear wheels that rotate about a second axis spaced from the first axis.

11. The play system of claim 1, further comprising a directing portion adapted to direct the toy vehicle from one of the first and section track sections to the other of the first and second track sections while maintaining the toy vehicle in an upright position.

12. The play system of claim 11, wherein the second track section includes a generally planar surface disposed between opposing guard rails, and wherein the directing portion includes a vertically disposed surface adjacent to the second track section, and wherein the vertically disposed surface is substantially coplanar with at least a portion of one of the guard rails.

13. A play system, comprising:

a toy vehicle, including:

a chassis having a top surface and a bottom surface, the bottom surface defining at least a first plane and including structure configured to define a pair of substantially parallel grooves across the bottom surface of the chassis, wherein the grooves are both substantially outwardly concave relative to the first plane, and wherein at least a portion of the bottom surface is magnetic, and a plurality of wheels rotatably mounted to the chassis and configured to roll the chassis on a surface in a predetermined rolling direction, the predetermined rolling direction substantially transverse to the pair of substantially parallel grooves; and a playset, including:

a first track section adapted to engage the grooves on the bottom surface of the toy vehicle for slidable movement of the toy vehicle thereon;

a second track section adapted to engage the plurality of wheels of the toy vehicle for rolling movement of the toy vehicle thereon; and a connecting portion coupling the track sections;

a magnetically attractive target disposed along a track portion and configured to magnetically engage the toy vehicle.

14. The play system of claim 13, further including a ramp section selectively actuable to launch a toy vehicle from one of the track sections toward the magnetically attractive target.

15. A playset for use with a toy vehicle having a chassis with a top surface, a bottom surface including structure configured to define a pair of substantially parallel grooves across the bottom surface, and a plurality of wheels rotatably mounted to the chassis; the playset comprising:

a first track section adapted to engage the grooves on the bottom surface of the toy vehicle chassis for slidable movement of the toy vehicle thereon;

a second track section adapted to engage the plurality of wheels of the toy vehicle for rolling movement of the toy vehicle thereon;

a connecting portion to couple the first track section with the second track section; and a directing portion adapted to stop the toy vehicle from moving after travelling off one of the coupled track sections to allow the toy vehicle to fall, via gravitational forces, onto the other of the coupled track sections.

16. The playset of claim 15, further including the toy vehicle.

17. The playset of claim 15, further including a ramp section selectively actuable to launch a toy vehicle from one of the track sections.

18. The playset of claim 15, wherein the directing portion is further adapted to direct the toy vehicle from one of the coupled track sections to the other of the coupled track sections while maintaining the toy vehicle in an upright position.

19. A playset for a toy vehicle, the playset comprising:

a first track section that includes a pair of parallel bars connected by a plurality of spaced ties;

a second track section with a generally planar surface disposed between opposing guard rails;

a connecting portion to couple the first track section with the second track section; and a directing portion adapted to stop the toy vehicle from moving after travelling off the first track section to allow the toy vehicle to fall, via gravitational forces, onto the second track section while maintaining the toy vehicle in an upright position.

20. The playset of claim 19, further including:

a base;

a support portion coupled to the base and adapted to support at least one track section at an incline with respect to the base.

21. A playset for a toy vehicle, the playset comprising:

a first track section that includes a pair of parallel bars connected by a plurality of spaced ties;

a second track section with a generally planar surface disposed between opposing guard rails;

a connecting portion to couple the first track section with the second track section; and a directing portion adapted to direct the toy vehicle from the first track section to the second track section while maintaining the toy vehicle in an upright position, wherein the directing portion includes a vertically disposed surface adjacent to the second track section, and wherein the vertically disposed surface is substantially coplanar with at least a portion of one of the guard rails.

22. A playset for use with a toy vehicle having a chassis with a top surface, a bottom surface including structure configured to define a pair of substantially parallel grooves across the bottom surface, and a plurality of wheels rotatably mounted to the chassis, the playset comprising:

a first track section adapted to engage the grooves on the bottom surface of the toy vehicle chassis for slidable movement of the toy vehicle thereon;

a second track section adapted to engage the plurality of wheels of the toy vehicle for rolling movement of the toy vehicle thereon;

a connecting portion to couple the first track section with the second track section; and a directing portion adapted to direct the toy vehicle from one of the coupled track sections to the other of the coupled track sections, wherein the directing portion is further adapted to direct the toy vehicle from one of the coupled track sections to the other of the coupled track sections while maintaining the toy vehicle in an upright position, wherein the second track section includes a generally planar surface disposed between opposing guard rails, and wherein the directing portion includes a vertically disposed surface adjacent to the second track section, and wherein the vertically disposed surface is substantially coplanar with at least a portion of one of the guard rails.

* * * * *